US008045898B2

(12) United States Patent
Kitaoka

(10) Patent No.: US 8,045,898 B2
(45) Date of Patent: Oct. 25, 2011

(54) POWDER CONVEYANCE UNIT AND IMAGE FORMING APPARATUS INCLUDING SAME

(75) Inventor: Satoshi Kitaoka, Ebina (JP)

(73) Assignee: Ricoh Company Limited, Tokyo (JP)

( * ) Notice: Subject to any disclaimer, the term of this patent is extended or adjusted under 35 U.S.C. 154(b) by 441 days.

(21) Appl. No.: 12/261,651

(22) Filed: Oct. 30, 2008

(65) Prior Publication Data

US 2009/0110429 A1 Apr. 30, 2009

(30) Foreign Application Priority Data

Oct. 31, 2007 (JP) ..... 2007-282758

(51) Int. Cl.
*G03G 15/08* (2006.01)
*G03G 21/10* (2006.01)

(52) U.S. Cl. ..... 399/258; 399/358; 399/359

(58) Field of Classification Search ..... 399/258, 399/261, 358, 359, 360, 99; 222/DIG. 1, 222/167

See application file for complete search history.

(56) References Cited

U.S. PATENT DOCUMENTS 6,085,062 A * 7/2000 Mizuishi et al. ..... 399/358
7,222,471 B2 5/2007 Matsumoto et al. ..... 53/449
7,333,763 B2 * 2/2008 Choi ..... 399/358
7,437,116 B2 * 10/2008 Lee ..... 399/359
7,593,672 B2 * 9/2009 Woo ..... 399/258
7,809,313 B2 10/2010 Kitaoka
7,894,760 B2 * 2/2011 Gunbe ..... 399/358
2006/0226046 A1 10/2006 Matsumoto et al. ..... 206/597

FOREIGN PATENT DOCUMENTS

JP 11-231655 8/1999
JP 2001-154556 6/2001
JP 2006-85202 3/2006
JP 4050056 B2 12/2007

* cited by examiner

*Primary Examiner* — Sophia S Chen
(74) *Attorney, Agent, or Firm* — Oblon, Spivak, McClelland, Maier & Neustadt, L.L.P.

(57) ABSTRACT

A powder conveyance unit, providable to an image forming apparatus, includes a path forming member configured to form a powder conveyance path including an inner wall to convey powder therethrough and connect first and second powder containers, and a substantially planar plate-like powder remover configured to remove powder adhering to the inner wall of the powder conveyance path. The plate-like powder remover is disposed in the powder conveyance path with both lateral edges thereof in a width direction perpendicular to a powder conveyance direction in the powder conveyance path contacting or nearly contacting the inner wall of the powder conveyance path. Opposed flat surfaces of the plate-like powder remover moves reciprocally between opposed surfaces of the inner wall of the powder conveyance path to remove powder adhering to the surfaces of the inner wall of the powder conveyance path.

18 Claims, 6 Drawing Sheets

POWDER CONVEYANCE UNIT AND IMAGE FORMING APPARATUS INCLUDING SAME

CROSS-REFERENCE TO RELATED APPLICATIONS

The present invention claims priority pursuant to 35 U.S.C. §119 from Japanese Patent Application No. 2007-282758, filed on Oct. 31, 2007 in the Japan Patent Office, the contents and disclosures of which are hereby incorporated by reference herein in their entirety.

BACKGROUND OF THE INVENTION

1. Field of the Invention

Illustrative embodiments of the present invention generally relate to a powder conveyance unit and an image forming apparatus including the powder conveyance unit, and more particularly, to a powder conveyance unit for conveying powder such as toner, and an image forming apparatus such as a printer, copier, and facsimile machine for forming images with the powder.

2. Discussion of the Related Art

Related-art image forming apparatuses generally include a developing unit, in which developer, containing mainly toner but also carrier particles, is accommodated to develop a latent image formed on an image carrier into a visible image.

Since toner contained in the developer is constantly consumed when developing images whereas the carrier is not, new or unused toner may need to be additionally supplied to the developing unit. Such new or unused toner is conveyed from a toner container provided in the apparatus to the developing unit so as to replenish the developer in the developing unit.

Such related-art image forming apparatus further includes a cleaning unit that collects residual toner remaining on the image carrier after transfer of the toner image from the image carrier to a transfer member. The residual toner collected by the cleaning unit is conveyed to and collected in a waste toner collecting unit or the developing unit for reuse and recycling.

An image forming apparatus that employs a known technique conveys free-falling toner from a toner container to a developing unit via a toner conveyance path in a toner conveyance unit therein. In such a toner conveyance unit, toner particles can adhere to small or narrow gaps or uneven portions on inner walls of a toner conveyance path forming member that forms the toner conveyance path and thus remain in the toner conveyance path after conveyance of toner. The toner particles adhering to the inner wall as described above accumulate with time and become firmly fixed to the inner walls due to changes in ambient temperature and/or humidity in the image forming apparatus. Accumulation of toner particles on the inner walls of the toner conveyance path makes the toner conveyance path narrower, which can cause toner to clog in the toner conveyance path and result in poor toner conveyance.

To counteract this problem, the image forming apparatus employing the above-described known technique may include a toner discharge opening and a rotatably moving or rocking member. The toner discharge opening is disposed on a side wall forming the toner conveyance path to discharge toner to the toner conveyance path. The rocking member, such as a wire, is rotatably movable along a certain area of the inner wall of the toner conveyance path facing the toner discharge opening. By contacting the rocking member against toner particles that adhere to the inner wall facing the toner discharge opening, the toner particles can be removed from the inner wall. Thus, accumulation of toner particles on the inner wall of the toner conveyance path over time can be prevented, which can further prevent that narrowing of the toner conveyance path due to toner particle accumulations.

However, in the related-art image forming apparatus employing the above-described known technique, the rocking member cannot remove toner adhering to areas other than the above-described area of the inner wall of the toner conveyance path. Therefore, toner can accumulate with time onto the other areas of the inner wall of the toner conveyance path, which can cause the toner conveyance path to become narrower, and can result in poor toner conveyance.

SUMMARY OF THE INVENTION

Exemplary aspects of the present invention have been made in view of the above-described circumstances.

Exemplary aspects of the present invention provide a powder conveyance unit that can effectively convey toner from one powder container to another and further remove residual powder remaining on walls in the powder conveyance unit.

Other exemplary aspects of the present invention provide an image forming apparatus that can include the above-described powder conveyance unit.

In one exemplary embodiment, a powder conveyance unit includes a path forming member configured to form a powder conveyance path including an inner wall to convey powder therethrough and connect a first powder container and a second powder container to pass the powder from the first powder container to the second powder container through the powder conveyance path, and a substantially planar plate-like powder remover configured to remove powder adhering to the inner wall of the powder conveyance path. The plate-like powder remover is disposed in the powder conveyance path with both lateral edges thereof in a width direction perpendicular to a powder conveyance direction in the powder conveyance path contacting or nearly contacting the inner wall of the powder conveyance path. Opposed flat surfaces of the plate-like powder remover moving reciprocally between opposed surfaces of the inner wall of the powder conveyance path to remove powder adhering to the surfaces of the inner wall of the powder conveyance path.

The plate-like powder remover may move in a direction intersecting the powder conveyance direction in the powder conveyance path.

One end of the plate-like powder remover may be rotatably fixed to a bearing member and a free end of the plate-like powder remover extends in the powder conveyance direction.

The free end of the plate-like powder remover may include a substantially elastic portion.

The above-described powder conveyance unit may further include a moving mechanism configured to move the plate-like powder remover. The moving mechanism may move the plate-like powder remover between completion of one conveyance of toner from the first powder container to the powder conveyance path and start of a subsequent conveyance of toner from the first powder container to the powder conveyance path.

The moving mechanism may move the plate-like powder remover after completion of conveyance of the powder from the first powder container to the powder conveyance path.

The first powder container may include a rotating powder conveyor configured to convey the powder upward to the powder conveyance path during rotation thereof. The moving mechanism may include a rotary shaft rotatably fixing the plate-like powder remover and an arm attached to the rotary shaft, each integrally mounted on the plate-like powder remover. The rotation of the powder conveyor may convey the powder upward causing the powder conveyor to contact the arm and move the plate-like powder remover.

Further, in one exemplary embodiment, an image carrier configured to carry an image on a surface thereof, a developing unit configured to develop a latent image formed on the surface of the image carrier into a toner image with toner, a transfer unit configured to transfer the toner image on the surface of the image carrier onto a transfer member, a cleaning unit configured to remove residual toner remaining on the surface of the image carrier after transfer, and the above-described powder conveyance unit. The powder conveyance unit may serve as one of a first toner conveyance unit configured to convey toner from a toner supplier configured to contain new toner to the developing unit, a second toner conveyance unit configured to convey collected toner from the cleaning unit to the developing unit, and a third toner conveyance unit configured to convey collected toner from the cleaning unit to a waste toner collecting unit.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
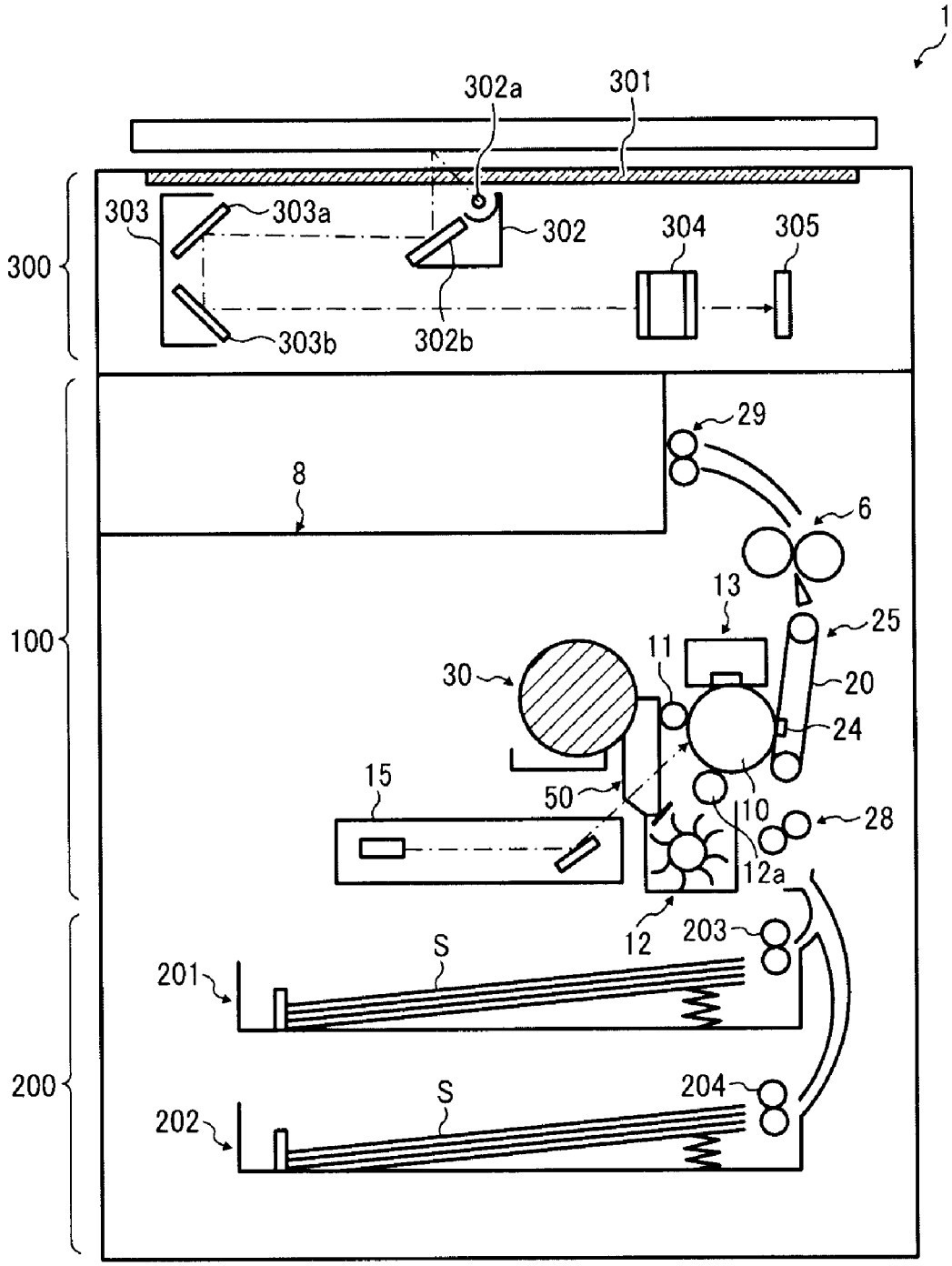
FIG. 1 is a schematic configuration of a copier according to an exemplary embodiment of the present invention.

In describing preferred embodiments illustrated in the drawings, specific terminology is employed for the sake of clarity. However, the disclosure of the present invention is not intended to be limited to the specific terminology so selected and it is to be understood that each specific element includes all technical equivalents that operate in a similar manner.

Referring now to the drawings, wherein like reference numerals designate identical or corresponding parts throughout the several views, preferred embodiments of the present invention are described.

Exemplary embodiments applied to an electrophotographic copier 1 serving as an image forming apparatus (hereinafter, referred to as a "copier 1") according to an exemplary embodiment of the present invention are described in detail below.

FIG. 1 is a schematic configuration of the copier 1 according to an exemplary embodiment of the present invention.

In FIG. 1, the copier 1 includes an image forming mechanism 100, a sheet feeding mechanism 200, and a scanner 300.

The image forming mechanism 100 includes a photoconductor 10 serving as an image carrier, a charging unit 11, a developing unit 12, a cleaning unit 13 that cleans the photoconductor 10, and an optical writing unit 15 that optically writes an electrostatic latent image on a surface of the photoconductor 10.

The copier 1 further includes a transfer unit 25, a toner supplying unit 30 serving as a first powder container, a fixing unit 6, a pair of sheet discharge rollers 29, and a stacker 8.

The transfer unit 25 is located in the vicinity of the photoconductor 10 and includes a sheet conveyor belt 20. The sheet conveyor belt 20 that serves as a transfer member forms an endless belt that is extended by and spanned around multiple belt supporting rollers including a transfer roller 24, and rotates in a clockwise direction in FIG. 1.

The toner supplying unit 30 that serves as a first powder container includes a toner bottle, not illustrated, that accommodates toner for supplying to the developing unit 12 that serves as a second powder container via a toner conveyance unit 50, which will be described later.

The fixing unit 6 fixes a toner image on the photoconductor 10 to a recording sheet S that serves as a recording medium.

The pair of sheet discharge rollers 29 discharges the recording sheet S after fixing to outside of the copier 1 to be stacked in the stacker 8 provided on top of a main body of the copier 1.

The sheet feeding mechanism 200 is provided below the image forming mechanism 100 in the copier 1, and includes a first sheet feed cassette 201, a second sheet feed cassette 202, a first sheet feed roller 203, and a second sheet feed roller 204.

Each of the first sheet feed cassette 201 and the second sheet feed cassette 202 accommodate multiple recording sheets S serving as recording media in a sheet stack. The first sheet feed cassette 201 and the second sheet feed cassette 202 cause the first sheet feed roller 203 and the second sheet feed roller 204 to rotate, respectively, so that the recording sheet S placed on top of the sheet stack of the recording sheets S can be separated from other recording sheets S and fed to a sheet feed path. A pair of registration rollers 28 is disposed in the vicinity of a most distal end of the sheet feed path. When the recording sheet S in the sheet feed path is sandwiched between the pair of registration rollers 28, the sheet conveyance temporarily stops. In synchronization with a movement of the toner image formed on the surface of the photoconductor 10 according to a process described below, the pair of registration rollers 28 resumes so that the recording sheet S is fed toward a transfer nip, which will be described later.

The scanner 300 is disposed above the image forming mechanism 100 to scan an image of an original document, not shown, which may be placed on a contact glass 301, and includes a first moving member 302 that includes a document illuminating light source 302*a* and a first reflection mirror 302*b*, a second moving member 303 that includes a second reflection mirror 303*a* and a third reflection mirror 303*b*, a collection lens 304, and an image sensor 305.

The first moving member 302 moves along a direction of a surface of the original document, which is a horizontal direction in FIG. 1, while illuminating the original document placed on the contact glass 301 with a reading light emitted from the document illuminating light source 302*a* so as to scan the original document. The light obtained by scanning the original document is reflected by the first reflection mirror 302*b* of the first moving member 302 and the second reflection mirror 303*a* and the third reflection mirror 303*b* of the second moving member 303 sequentially. Then, the light passes the collection lens 304 to enter the image sensor 305.

The image sensor 305 that includes components, such as a CCD, generates an image signal based on the incident scanning light. The image signal is transmitted to a scan control part, not shown, to be digitalized for image processing. The scan control part then drives the optical writing unit 15 of the image forming mechanism 100 based on the processed image signal. The optical writing unit 15 further optically scans the surface of the photoconductor 10 to form an electrostatic latent image on the surface thereof.

In the image forming mechanism 100, the charging unit 11 uniformly charges an outer circumferential surface of the photoconductor 10 that rotates in a counterclockwise direction in FIG. 1. The charged surface of the photoconductor 10 is then irradiated by the optical writing unit 15 to form and carry the electrostatic latent image thereon. The developing unit 12 develops the electrostatic latent image formed on the surface of the photoconductor 10 into a toner image as a visible image with toner that is supplied by a developing roller 12*a* of the developing unit 12.

The sheet conveyor belt 20 is supported by the multiple belt supporting rollers and rotates endlessly in the vicinity of the photoconductor 10. The transfer roller 24, which is one of the multiple belt supporting rollers disposed inside a loop of the sheet conveyor belt 20, contacts an outer surface of the sheet conveyor belt 20 (or an outer circumferential surface of the loop thereof) to the surface of the photoconductor 10 with a certain pressure. By contacting the outer surface of the sheet conveyor belt 20 to the surface of the photoconductor 10, a transfer nip is formed therebetween. A transfer bias is applied to the transfer roller 24 to form an electrical field for transfer in the transfer nip.

As described above, the recording sheet S that is fed and conveyed by the pair of registration rollers 28 is sandwiched between the transfer nip and conveyed forward to receive the toner image from the photoconductor 10. With application of a nip pressure at the transfer nip and the electrical field for transfer, the toner image is transferred onto the recording sheet S. Thus, while being attached to or carried on the outer surface of the sheet conveyor belt 20, the recording sheet S having the toner image thereon is conveyed according to the endless movement of the sheet conveyor belt 20 to the fixing unit 6.

The fixing unit 6 includes a fixing roller and a pressure roller and these rollers form a fixing nip therebetween. The fixing roller rotates while including a heater such as a halogen lamp therein. The pressure roller is held in contact with the fixing roller and rotates with the fixing roller.

After being detached from the sheet conveyor belt 20 and conveyed to the fixing unit 6, the recording sheet S is sandwiched between the fixing nip, where the nip pressure and heat are applied to the recording sheet S so as to fix the toner image to the recording sheet S. Thus, the recording sheet S to which the toner image is fixed is conveyed out from the fixing unit 6 to the stacker 8 via the pair of sheet discharge rollers 29.

After transfer, some amount of toner still remains on the surface of the photoconductor 10. Such residual toner is removed by the cleaning unit 13 from the surface of the photoconductor 10 and is collected to a toner collection tank, not shown. Alternatively, the residual toner collected by the cleaning unit 13 can be conveyed to the developing unit 12 for reuse and recycling. After cleaned by the cleaning unit 13, the surface of the photoconductor 10 is uniformly charged by the charging unit 11 again for a subsequent image forming operation.

The above-described operation is for forming an image based on the image data obtained in the scanner 300 by reading the original document placed on the contact glass 301. However, the above-described operation can be performed by a printer for forming an image based on image data sent by an external personal computer, etc.

Figure 2:
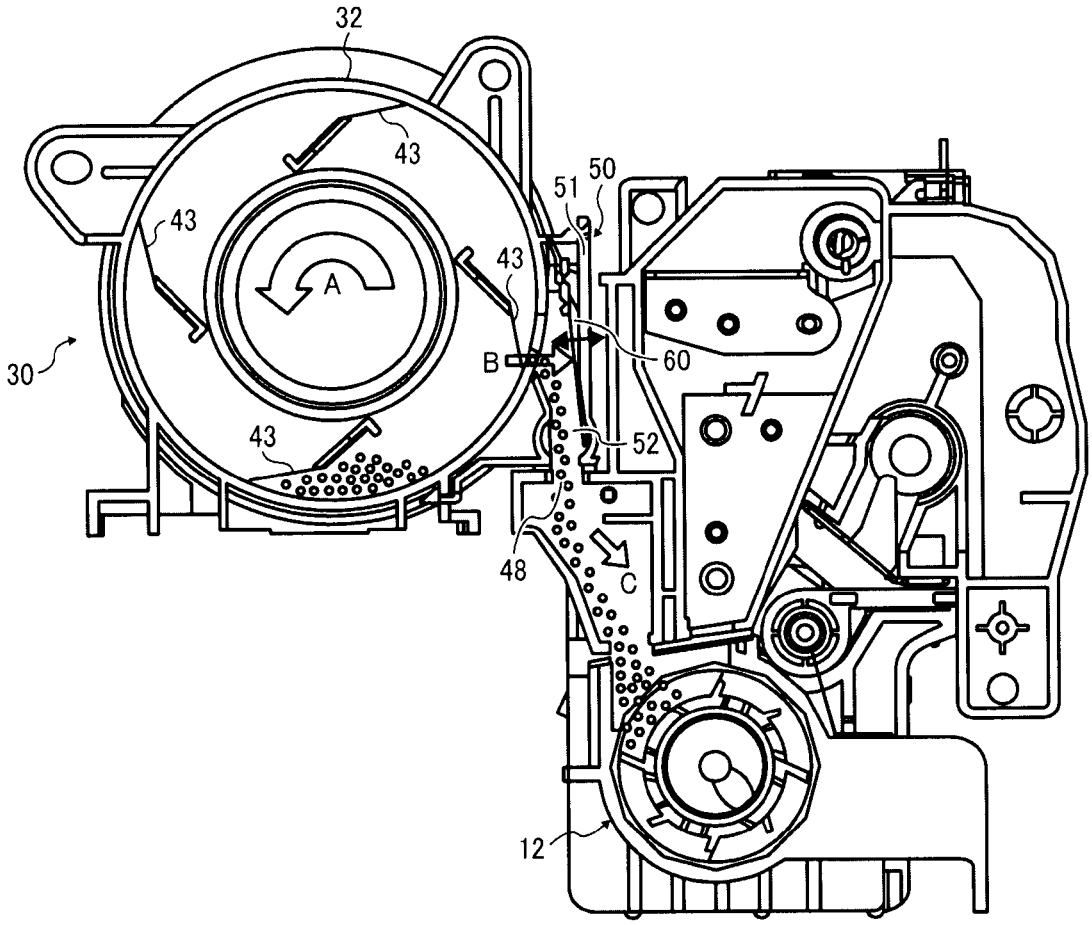
FIG. 2 is a schematic configuration of a toner conveyance unit and units disposed near the toner conveyance unit in the copier of FIG. 1.

Referring to FIG. 2, a description is given of the toner supplying unit 30 that supplies toner to the developer contained in the developing unit 12 when toner in the developer is used due to development of the electrostatic latent image formed on the surface of the photoconductor 10.

The toner supplying unit 30 includes a first hopper, not illustrated, and a second hopper 32.

The second hopper 32 receives toner conveyed from the first hopper and conveys the toner upward by multiple toner conveyance members 43 that rotate in a direction indicated by arrow A in the second hopper 32 in FIG. 2 to convey the supplied toner in a direction indicated by arrow B in FIG. 2 through a slit 30*a* (see FIGS. 3A to 3C) of a toner supply regulating member that is provided at an opening of the second hopper 32. The toner in a toner conveyance path 52 of the toner conveyance unit 50 then passes through a toner inlet 48 that serves as a developer inlet and falls into the developing unit 12 in a direction indicated by arrow C.

In the toner conveyance unit 50 having the above-described configuration, toner particles may adhere to small or narrow gaps or uneven portions on inner walls of a toner conveyance path forming member 51 that forms the toner conveyance path 52 so that the toner particles may remain in the toner conveyance path 52 after completion of a toner conveying operation. The toner particles adhering to the inner walls can accumulate with time and become firmly fixed to the inner walls due to changes in ambient temperature and/or humidity in the copier 1. Accumulation of toner particles on the inner walls of the toner conveyance path 52 makes the toner conveyance path 52 narrower. This can cause toner to clog in the toner conveyance path 52 and result in poor toner conveyance.

Therefore, the toner conveyance unit 50 according to the present invention includes a rocking member 60 disposed in the toner conveyance path 52. The rocking member 60 has a substantially planar plate-like shape and removes toner adhering to the inner walls so as not to cause accumulation of toner with time on the inner walls.

Now, following descriptions are given of the toner conveyance unit 50 and units modified based on the toner conveyance unit 50 according to exemplary embodiments of the present invention.

First Exemplary Embodiment

Referring to FIGS. 3A through 3C and FIG. 4, descriptions are given of movement of the rocking member 60 in the toner conveyance unit 50 according to a first exemplary embodiment of the present invention.

Figure 3A:
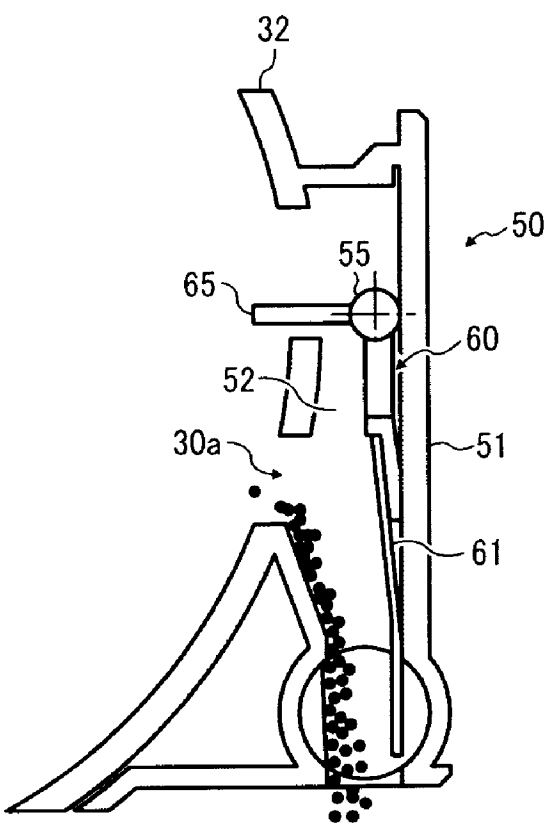
FIG. 3A is a drawing illustrating a toner conveying operation performed by a toner conveyance unit, according to a first exemplary embodiment of the present invention, when toner passes through a toner conveyance path thereof and a rocking member remains in its home position.
Figure 3B:
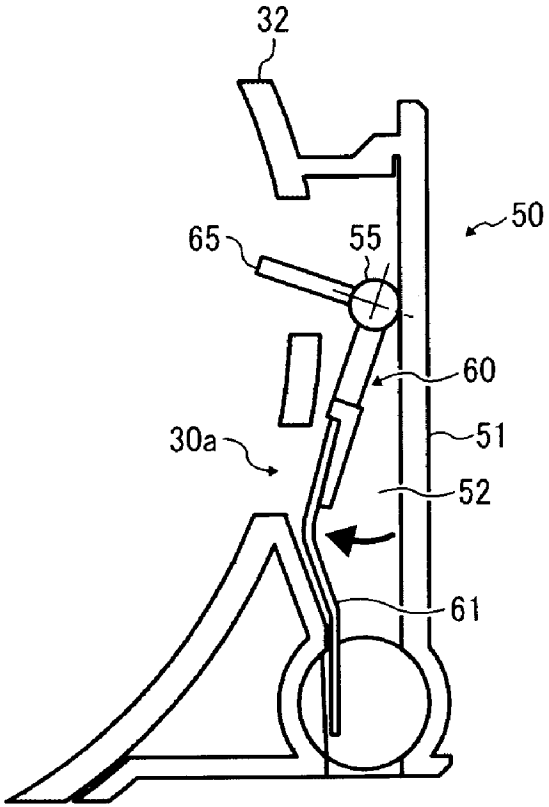
FIG. 3B is a drawing illustrating a toner conveying operation subsequent to the operation of FIG. 3A when the rocking member removes the toner adhering to inner walls of the toner conveyance path, according to the first exemplary embodiment of the present invention.
Figure 3C:
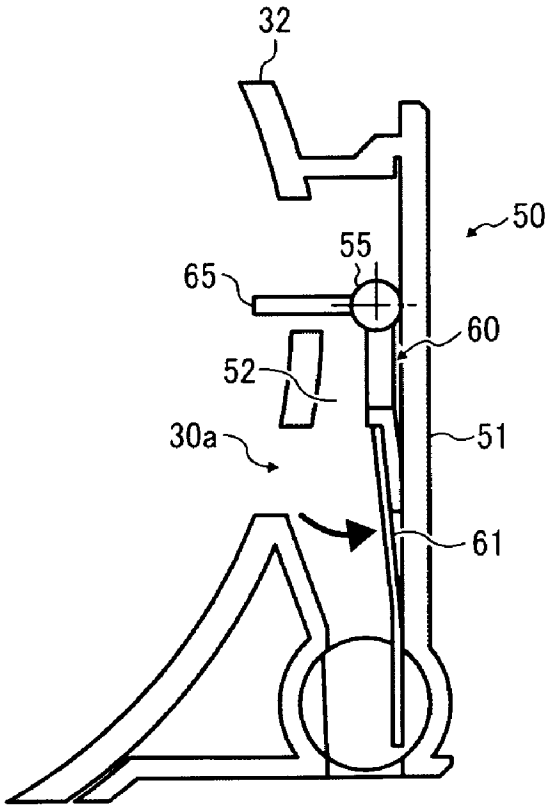
FIG. 3C is a drawing illustrating a toner conveying operation subsequent to the operation of FIG. 3B when the toner is removed and the rocking member returns to the home position, according to the first exemplary embodiment of the present invention.

As shown in FIGS. 3A through 3C, the rocking member 60 moves or rotates forward and backward in a direction indicated by arrows in FIGS. 3B and 3C about a rotating shaft 55 in the toner conveyance path 52. With the above-described actions, powder or toner that adheres to the inner walls of the toner conveyance path 52 can be removed.

Figure 4:
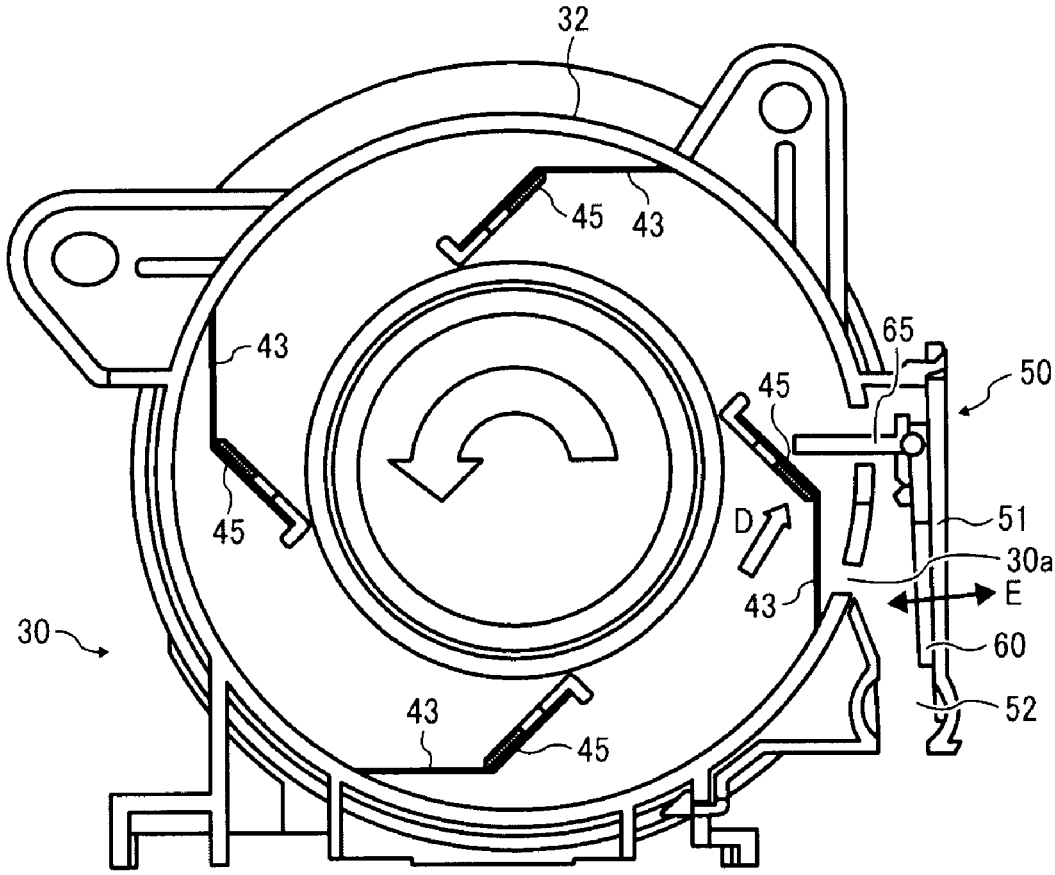
FIG. 4 is a schematic diagram of a rocking mechanism that rocks the rocking member of FIGS. 3A through 3C, according to the first exemplary embodiment of the present invention.

In the first exemplary embodiment, when the second hopper 32 of the toner supplying unit 30 rotates as shown in FIG. 4, multiple projecting parts 45 of the multiple toner conveyance members 43 sequentially move an arm 65 of the rocking member 60 in a direction indicated by arrow D shown in FIG. 4 so as to move the rocking member 60 to a direction indicated by arrow E shown in FIG. 4. After each of the projecting parts 45 passes the arm 65, a spring, not shown, which is provided to the rocking member 60 moves the rocking member 60 back to its home position.

Alternatively, the toner conveyance path forming member 51 can include an opening to extend a part of the arm 65 to an outside of the main body of the image forming apparatus, for example, so that a service person or the like can move the rocking member 60 manually for maintenance. At this time, it is desirable to provide a seal member, for example, to or in the vicinity of the opening to prevent leakage of toner from the above-described opening.

The rocking member 60 according to the first exemplary embodiment of the present invention is disposed in the toner conveyance path 52 with both lateral edges thereof in a width direction perpendicular to a toner conveyance direction in the toner conveyance path 52 contacting or nearly contacting the inner walls of the toner conveyance path 50. Under the above-described condition, opposed flat surfaces of the rocking member 60 reciprocally moves or rotates in a direction corresponding to the thickness of the rocking member 60, which intersects the toner conveyance direction. That is, the opposed flat surfaces of the rocking member 60 reciprocally move between opposed surfaces of the inner walls of the toner conveyance path 52. The opposed flat surfaces of the rocking member 60 contact the respective opposed surfaces of the inner walls in the direction of movement of the rocking member 60. By reciprocally moving the rocking member 60 as shown in FIGS. 3B and 3C, the opposed flat surfaces of the rocking member 60 contact toner adhering to the opposed surfaces of the inner walls to scrape off or remove the toner from the inner walls.

When the rocking member 60 reciprocally rotates or rotatably moves about the rotation axis or the rotating shaft 55 in the direction indicated by arrows in FIGS. 3B and 3C, the both lateral edges in the width direction of the rocking member 60 can contact toner particles that adhere to the inner walls, thereby removing the toner from the respective opposed surfaces of the inner walls of the toner conveyance path 52.

Further in the first exemplary embodiment, the rocking member 60 employs an elastic member 61 for forming a part thereof. For example, the elastic member 61 can form a part where the rocking member 60 interferes with the inner walls during a movement of the rocking member 60 in the toner conveyance path 52. By employing the elastic member 61 for a part of the rocking member 60, a difference between a form of the toner conveyance path 52 and trajectory of the parallel reciprocation of the rocking member 60 can be absorbed. As a result, the rocking member 60 having the elastic member 61 can remove the toner from the overall surfaces of the inner walls of the toner conveyance path 52 even when the toner conveyance path 52 has a complex form.

Further, airflow generated due to reciprocating or back and forth movement of the rocking member 60 in the toner conveyance path 52 can blow and remove the toner adhering to the inner walls. To increase an effect of blowing air to remove residual toner adhering to the inner walls, the rocking member 60 may move or reciprocate at higher speed in the toner conveyance path 52, for example, at a speed of 3 m/s.

Next, a description is given of detailed operations of a powder conveyance mechanism according to the first exemplary embodiment of the present invention in reference to FIGS. 3A, 3B, and 3C.

As shown in FIG. 3A, toner comes from the slit 30*a* of the second hopper 32 of the toner supplying unit 30, and passes through the toner conveyance path 52 of the toner conveyance unit 50 to the developing unit 12. After completion of the toner conveying operation from the second hopper 32 of the toner supplying unit 30 to the developing unit 12 via the toner conveyance unit 50, as shown in FIG. 3B, the rocking member 60 may move from its home position where the rocking member 60 does not disturb the toner conveying operation in the toner conveyance path 52 and reciprocally rotate at a given high speed to a direction indicated by arrow as shown in FIG. 3B. With this action, the powder or toner that adheres to the inner walls of the toner conveyance path 52 is scraped off or blown away to be removed from the inner walls. After the above-described movement, the rocking member 60 moves or rotates at a high speed and returns to the home position, as shown in FIG. 3C.

If the rocking member 60 moves in the middle of the process of toner conveyance from the second hopper 32 of the toner supplying unit 30 to the toner conveyance path 52 of the toner conveyance unit 50, it is likely that the rocking member 60 itself disturbs the toner conveyance. To avoid this inconvenience, it is preferable that the rocking member 60 reciprocally rotates in the toner conveyance path 52 between completion of one conveyance of toner from the toner supplying unit 30 to the toner conveyance path 52 and start of a subsequent conveyance of toner from the toner supplying unit 30 to the toner conveyance path 52. Further, as long as the rocking member 60 can appropriately remove toner from the inner walls of the toner conveyance path 52, the number and time period of reciprocating movement of the rocking member 60 are not particularly limited to but can be determined according to results of tests that may be conducted in advance.

As one example of movement of the rocking member 60, in this exemplary embodiment and subsequent exemplary embodiments of the present invention, the rocking member 60 provided in the toner conveyance path 52 starts to move immediately after completion of conveyance of toner from the toner supplying unit 30 to the toner conveyance path 52.

As described in the first exemplary embodiment, toner that adheres to the inner walls of the toner conveyance path 52 can be removed by reciprocally moving the rocking member 60 in the toner conveyance path 52. The configuration of the toner conveyance unit 50 can be modified according to the shape of the toner conveyance path 52. Following descriptions are given of exemplary embodiments of various versions of the toner conveyance path 52.

Second Exemplary Embodiment

Figure 5A:
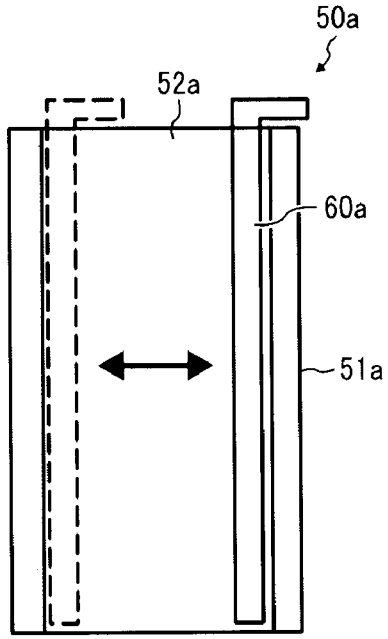
FIG. 5A is a cross-sectional view of a toner conveyance unit according to a second exemplary embodiment.
Figure 5B:
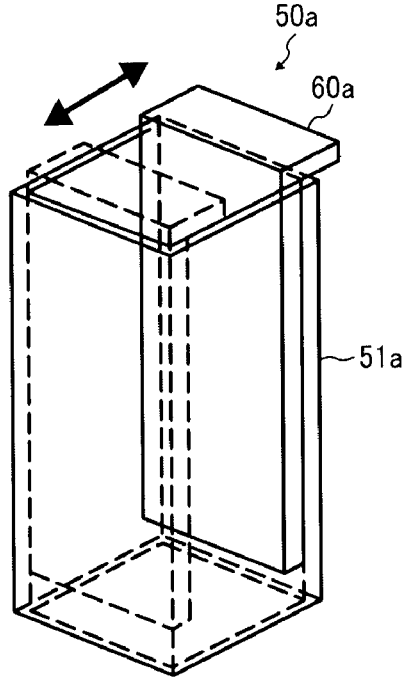
FIG. 5B is a perspective view of the toner conveyance unit of FIG. 5A.

Referring to FIGS. 5A and 5B, descriptions are given of schematic structures of an interior for a toner conveyance path

52*a* of a toner conveyance unit 50*a* according to a second exemplary embodiment of the present invention.

The toner conveyance path 52*a* of the toner conveyance unit 50*a* has substantially same elements, components, and functions as the toner conveyance path 52 of the toner conveyance unit 50 according to the first exemplary embodiment, except that the toner conveyance path 52*a* has a quadrangular prism shape and that a rocking member 60*a* is formed without including the elastic member 61. Functions of elements or components of the toner conveyance unit 50*a* according to the second exemplary embodiment may be similar to those of the toner conveyance unit 50 according to the first exemplary embodiment, and therefore the descriptions thereof are omitted or summarized.

As shown in FIG. 5A, the toner conveyance unit 50*a* includes the rocking member 60*a* that moves reciprocally in parallel in a direction indicated by arrow in FIG. 5A to a toner conveyance path forming member 51*a* of the toner conveyance path 52*a* so as to remove powder or toner adhering to the inner walls of the toner conveyance path 52*a* therefrom.

Similar to the first exemplary embodiment, the rocking member 60*a* according to the second exemplary embodiment of the present invention is disposed in the toner conveyance path 52*a* with both lateral edges thereof in a width direction perpendicular to a toner conveyance direction in the toner conveyance path 52*a* contacting or nearly contacting the inner walls of the toner conveyance path 52*a*. Under the above-described condition, opposed flat surfaces of the rocking member 60*a* reciprocally moves in a direction corresponding to the thickness of the rocking member 60*a*, which intersects the toner conveyance direction. That is, the opposed flat surfaces of the rocking member 60*a* reciprocally move between opposed surfaces of the inner walls of the toner conveyance path 52*a*. The opposed flat surfaces of the rocking member 60*a* contact the respective opposed surfaces of the inner walls in the direction of movement of the rocking member 60*a*. By reciprocally moving in a direction as indicated by arrow shown in FIG. 5A, the opposed flat surfaces of the rocking member 60*a* contact toner adhering to the opposed surfaces of the inner walls to scrape off or remove the toner from the inner walls of the toner conveyance path 52*a* can be scraped off or removed from the inner walls.

When the rocking member 60*a* reciprocally moves in a direction indicated by arrow in FIG. 5B, the both lateral edges in the width direction of the rocking member 60*a* can contact toner particles that adhere to the inner walls, thereby removing the toner from the respective opposed surfaces of the inner walls of the toner conveyance path 52*a*.

As in the first exemplary embodiment, airflow generated due to reciprocating or back and forth movement of the rocking member 60*a* in the toner conveyance path 52*a* can blow and remove the toner adhering to the inner walls in the second exemplary embodiment. To increase an effect of blowing air to remove residual toner adhering to the inner walls, similar to the first exemplary embodiment, the rocking member 60*a* may move reciprocally at higher speed in the toner conveyance path 52*a* at a speed of 3 m/s, for example.

Third Exemplary Embodiment

Figure 6:
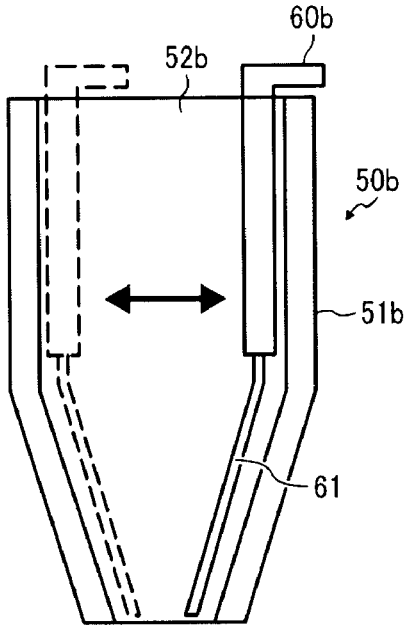
FIG. 6 is a cross-sectional view of a toner conveyance unit according to a third exemplary embodiment of the present invention.

Referring to FIG. 6, a description is given of a schematic structure of an interior for a toner conveyance path 52*b* of a toner conveyance unit 50*b* according to a third exemplary embodiment of the present invention.

The toner conveyance unit 50*b* has substantially same units, components and functions as the toner conveyance units 50 and 50*a* according to the first and second exemplary embodiments, except that the toner conveyance path 52*b* of the toner conveyance unit 50*b* has a tapered shape from a substantially center part to a bottom part in a vertical direction thereof, as shown in FIG. 6. Further, different from the rocking member 60*a* in the second exemplary embodiment, a rocking member 60*b* includes the elastic member 61 to flexibly contact the inner walls during a movement of the rocking member 60*b* in the toner conveyance path 52*b*. Functions of elements or components of the toner conveyance unit 50*b* according to the third exemplary embodiment may be similar to those of the toner conveyance units 50 and 50*a* according to the first and second exemplary embodiment, and therefore the descriptions thereof are omitted or summarized.

As described above, the toner conveyance unit 50*c* according to the third exemplary embodiment of the present invention includes the rocking member 60*b*. Similar to the above-described exemplary embodiments, the rocking member 60*b* according to the third exemplary embodiment of the present invention is disposed in the toner conveyance path 52*b* with both lateral edges thereof in a width direction perpendicular to a toner conveyance direction in the toner conveyance path 52*b* contacting or nearly contacting the inner walls of the toner conveyance path 50*b*. Under the above-described condition, opposed flat surfaces of the rocking member 60*b* reciprocally moves parallel to a toner conveyance path forming member 51*b* of the toner conveyance path 52*b* in a direction corresponding to the thickness of the rocking member 60*b*, which intersects the toner conveyance direction. That is, the opposed flat surfaces of the rocking member 60*b* reciprocally move between opposed surfaces of the inner walls of the toner conveyance path 52*b*. The opposed flat surfaces of the rocking member 60*b* contact the respective opposed surfaces of the inner walls in the direction of movement of the rocking member 60*b*. By reciprocally moving the rocking member 60*b* as shown in FIG. 6, the opposed flat surfaces of the rocking member 60*b* contact toner adhering to the opposed surfaces of the inner walls to scrape off or remove the toner from the inner walls. When the rocking member 60*b* reciprocally moves in the direction indicated by arrow in FIG. 6, the both lateral edges in the width direction of the rocking member 60*b* can contact toner particles that adhere to the inner walls, thereby removing the toner from the respective opposed surfaces of the inner walls of the toner conveyance path 52*b*.

Further, the rocking member 60*b* includes the elastic member 61 to flexibly contact the inner walls during a movement of the rocking member 60*b* in the toner conveyance path 52*b*. That is, the elastic member 61 can avoid interference in the parallel movement of the rocking member 60*b*. The elastic member 61 is employed to the rocking member 60*b* for a given area where the toner conveyance path 52*b* forms a tapered shape. By employing the elastic member 61 to fit to the taper area of the toner conveyance path 52*b*, opposed flat surfaces of the rocking member 60*b* that reciprocally move between opposed surfaces of the inner walls of the toner conveyance path 52*b* can avoid interference with the toner conveyance path 52*b* and can elastically deform its substantially planar plate-like shape to fit to contact the inner walls of the above-described area of the toner conveyance path 52*b* when the rocking member 60*b* moves reciprocally in a direction as indicated by arrow shown in FIG. 6. Therefore, in the toner conveyance path 52*b* illustrated in FIG. 6, the rocking member 60*b* having the elastic member 61 can scrape off or remove the toner adhering to the overall surfaces of the inner walls of the toner conveyance path 52*b* by reciprocally moving the rocking member 60*b* in parallel.

Further, the parallel reciprocation of the rocking member 60*b* generates airflow so that the toner adhering to the inner walls can be blown away or removed from the inner walls.

Fourth Exemplary Embodiment

Figure 7A:
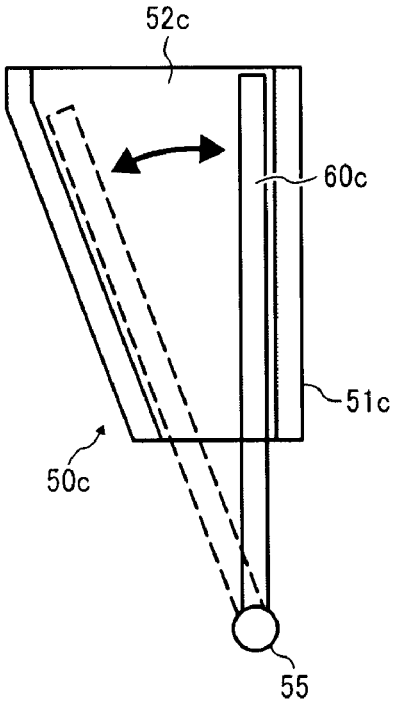
FIG. 7A is a cross-sectional view of a toner conveyance unit according to a fourth exemplary embodiment.
Figure 7B:
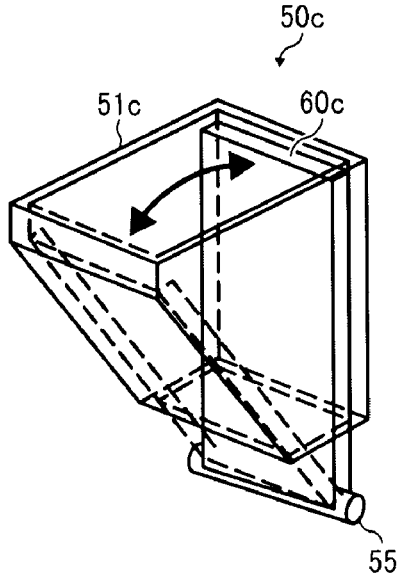
FIG. 7B is a perspective view of the toner conveyance unit of FIG. 7A.

Referring to FIGS. 7A and 7B, descriptions are given of schematic structures of an interior for a toner conveyance path 52*c* of a toner conveyance unit 50*c* according to a fourth exemplary embodiment of the present invention.

The toner conveyance path 52*c* of the toner conveyance unit 50*c* has substantially same elements, components, and functions as the toner conveyance paths 52, 52*a*, and 52*b* of the toner conveyance units 50, 50*a*, and 50*b* according to the first, second, and third exemplary embodiments. Except, the toner conveyance path 52*c* has a shape of a trapezoidal cross section as shown in FIG. 7A and that a rocking member 60*c* is formed without including the elastic member 61. Functions of elements or components of the toner conveyance unit 50*c* according to the fourth exemplary embodiment may be similar to those of the toner conveyance unit 50 according to the first exemplary embodiment, and therefore the descriptions thereof are omitted or summarized.

As shown in FIG. 7A, the toner conveyance unit 50*c* includes the rocking member 60*c* that reciprocally rotates about the rotating shaft 55 in a direction indicated by arrow in FIG. 7A to a toner conveyance path forming member 51*c* of the toner conveyance path 52*c* so as to remove powder or toner adhering to the inner walls of the toner conveyance path 52*c* therefrom.

Similar to the above-described exemplary embodiments, the rocking member 60*c* according to the fourth exemplary embodiment of the present invention is disposed in the toner conveyance path 52*c* with both lateral edges thereof in a width direction perpendicular to a toner conveyance direction in the toner conveyance path 52*c* contacting or nearly contacting the inner walls of the toner conveyance path 52*c*. Under the above-described condition, opposed flat surfaces of the rocking member 60*c* reciprocally moves about the rotating shaft 55 in a direction indicated by arrow shown in FIGS. 7A and 7B corresponding to the thickness of the rocking member 60*c*, which intersects the toner conveyance direction. That is, the opposed flat surfaces of the rocking member 60*c* reciprocally move or rotate between opposed surfaces of the inner walls of the toner conveyance path 52*c*. The opposed flat surfaces of the rocking member 60*c* contact the respective opposed surfaces of the inner walls in the direction of movement of the rocking member 60*c*. By reciprocally moving in a direction as indicated by arrow shown in FIGS. 7A and 7B, the opposed flat surfaces of the rocking member 60*c* contact toner adhering to the opposed surfaces of the inner walls and thus the toner adhering to the inner walls of the toner conveyance path 52*c* can be removed from the inner walls of the toner conveyance path 52*c*.

Further, when the rocking member 60*c* reciprocally moves about the rotating shaft 55 in a direction indicated by arrows in FIGS. 7A and 7B, the both lateral edges in the width direction of the rocking member 60*c* can contact toner particles that adhere to the inner walls, thereby removing the toner particles from the respective opposed surfaces of the inner walls of the toner conveyance path 52*c*.

As in the above-described exemplary embodiments, airflow generated due to reciprocating or back and forth movement of the rocking member 60*c* in the toner conveyance path 52*c* can blow and remove the toner adhering to the inner walls in the fourth exemplary embodiment. To increase an effect of blowing air to remove residual toner adhering to the inner walls, similar to the above-described exemplary embodiments, the rocking member 60*c* may move reciprocally at higher speed in the toner conveyance path 52*c* at a speed of 3 m/s, for example.

Fifth Exemplary Embodiment

Figure 8:
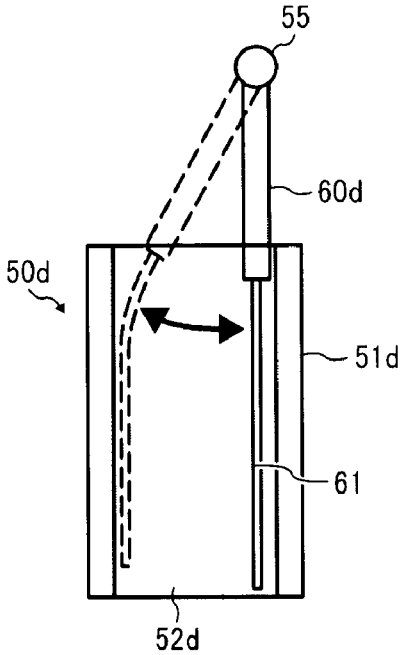
FIG. 8 is a cross-sectional view of a toner conveyance unit according to a fifth exemplary embodiment of the present invention.

Referring to FIG. 8, a description is given of a schematic structure of an interior for a toner conveyance path 52*d* of a toner conveyance unit 50*d* according to a fifth exemplary embodiment of the present invention.

The toner conveyance unit 50*d* has substantially same units, components, and functions as the toner conveyance units 50, 50*a*, 50*b*, and 50*c* according to the above-described exemplary embodiments. Except, the toner conveyance unit 50*d* is rectangular-shaped in a vertical direction thereof, as shown in FIG. 8. Further, different from the rocking member 60*d* in the second and fourth exemplary embodiments, a rocking member 60*d* includes the elastic member 61 to flexibly contact the inner walls during a movement of the rocking member 60*d* in the toner conveyance path 52*d* formed by a toner conveyance path forming member 51*d*. Functions of elements or components of the toner conveyance unit 50*d* according to the fifth exemplary embodiment may be similar to those of the toner conveyance units 50 according to the first exemplary embodiment, and therefore the descriptions thereof are omitted or summarized.

As described above, the toner conveyance unit 50*d* according to the fifth exemplary embodiment of the present invention includes a rocking member 60*d*. Similar to the above-described exemplary embodiments, the rocking member 60*d* according to the fifth exemplary embodiment of the present invention is disposed in the toner conveyance path 52*d* with both lateral edges thereof in a width direction perpendicular to a toner conveyance direction in the toner conveyance path 52*d* contacting or nearly contacting the inner walls of the toner conveyance path 50*d*. Under the above-described condition, opposed flat surfaces of the rocking member 60*d* reciprocally moves about the rotating shaft 55 in a direction corresponding to the thickness of the rocking member 60*d*, which intersects the toner conveyance direction. That is, the opposed flat surfaces of the rocking member 60*d* reciprocally move between opposed surfaces of the inner walls of the toner conveyance path 52*d*. The opposed flat surfaces of the rocking member 60*d* contact the respective opposed surfaces of the inner walls in the direction of movement of the rocking member 60*d*. By reciprocally moving the rocking member 60*d* as shown in FIG. 8, the opposed flat surfaces of the rocking member 60*d* contact toner adhering to the opposed surfaces of the inner walls to scrape off or remove the toner from the inner walls. When the rocking member 60*d* reciprocally moves in the direction indicated by arrow in FIG. 8, the both lateral edges in the width direction of the rocking member 60*d* can contact toner particles that adhere to the inner walls, thereby removing the toner from the respective opposed surfaces of the inner walls of the toner conveyance path 52*d*.

Further, the rocking member 60*d* according to the fifth exemplary embodiment of the present invention includes the elastic member 61 to flexibly contact the inner walls during a movement of the rocking member 60*d* in the toner conveyance path 52*d*. That is, the elastic member 61 can avoid interference in the reciprocating movement of the rocking member 60*d* in the toner conveyance path 52*d*. The elastic member 61 is employed to the rocking member 60*d* for a given area where the rocking member 60*d* contacts the inner walls of the toner conveyance path 52*d*. By employing the elastic member 61 to fit to the contact area of the rocking member 60*d* in the toner conveyance path 52*d*, opposed flat surfaces of the rocking member 60*d* that reciprocally move between opposed surfaces of the inner walls of the toner conveyance path 52*d* can avoid interference with the toner conveyance path 52*d* and can elastically deform its substantially planar plate-like shape to fit to contact the inner walls of the above-described area of the toner conveyance path 52*d* when the rocking member 60*d* moves reciprocally in a direction as indicated by arrow shown in FIG. 8. Therefore, in the toner conveyance path 52*d* illustrated in FIG. 8, the rocking member 60*d* having the elastic member 61 can scrape off or remove the toner adhering to the overall surfaces of the inner walls of the toner conveyance path 52*d* by reciprocally moving the rocking member 60*d*.

Further, the reciprocation of the rocking member 60*d* generates airflow so that the toner adhering to the inner walls can be blown away or removed from the inner walls.

As described above, the toner conveyance unit 50 serves as a powder conveyance unit and includes the toner supplying unit 30 that serves as a first powder container for containing powder material therein, the developing unit 12 that serves as a second powder container for containing the powder material conveyed from the toner supplying unit 30 via the toner conveyance unit 50, and the toner conveyance path forming member 51 that serves as a path forming member. The toner conveyance path forming member 51 forms the toner conveyance path 52 that serves as a powder conveyance path formed between the toner supplying unit 30 and the developing unit 12 for conveying the powder material therethrough. The toner conveyance unit 50 further includes the rocking member 60 that serves as a substantially planar plate-like powder remover for removing toner serving as powder that adheres to the inner walls of the toner conveyance path 52. Hereinafter, the suffixes "a", "b", "c", and "d" are omitted.

The rocking member 60 according to the above-described exemplary embodiments of the present invention is disposed in the toner conveyance path 52 with both lateral edges thereof in a width direction perpendicular to a toner conveyance direction in the toner conveyance path 52 contacting or nearly contacting the inner walls of the toner conveyance path 50.

Under the above-described condition, opposed flat surfaces of the rocking member 60 reciprocally moves or rotates in a direction corresponding to the thickness of the rocking member 60, which intersects the toner conveyance direction. That is, the opposed flat surfaces of the rocking member 60 reciprocally move between opposed surfaces of the inner walls of the toner conveyance path 52. The opposed flat surfaces of the rocking member 60 contact the respective opposed surfaces of the inner walls in the direction of movement of the rocking member 60.

Accordingly, by reciprocally moving the rocking member 60 in the toner conveyance path 52, the opposed flat surfaces of the rocking member 60 contact toner adhering to the opposed surfaces of the inner walls to scrape off or remove the toner from the inner walls.

Further, by reciprocally moving the rocking member 60 in the toner conveyance path 52, the both lateral edges in the width direction of the rocking member 60 can contact toner particles that adhere to the inner walls, thereby removing the toner from the respective opposed surfaces of the inner walls of the toner conveyance path 52. The above-described action can prevent toner from being accumulated on the overall surface of the inner walls in the toner conveyance path 52 and can further prevent toner clogging in the toner conveyance path 52, thereby preferably performing the toner conveyance.

Further, according to an exemplary embodiment of the present invention, the rocking member 60 moves in a direction intersecting the toner conveyance direction in the toner conveyance path 52. Therefore, in the toner conveyance path 52*d* having a rectangular cross section that extends in parallel to the toner conveyance direction, the accumulation of toner to the overall surfaces of the inner walls of the toner conveyance path 52*d* can be prevented easily, practically without extension of space of the toner supplying path.

Further, according to an exemplary embodiment of the present invention, the rotating shaft 55 supports one end of the rocking member 60 in the toner conveyance direction so that the rocking member 60 can rotatably move. Therefore, for example, in the toner conveyance path 52*c* having a trapezoidal cross section, the accumulation of toner to the overall surfaces of the inner walls of the toner conveyance path 52*c* can be prevented easily, practically without extension of space of the toner supplying path.

Further, according to an exemplary embodiment of the present invention, the rocking member 60 includes the elastic part including the elastic member 61. Therefore, difference between a form of the toner conveyance path 52, 52*b*, or 52*d* and trajectory of the parallel reciprocation of the rocking member 60 can be absorbed. As a result, even in the toner conveyance path 52 having a complex form, the accumulation of toner to the overall surfaces of the inner walls of the toner conveyance path 52*d* can be prevented easily, practically without extension of space of the toner supplying path.

Further, according to an exemplary embodiment of the present invention, the toner conveyance unit 50 further includes the arm 65 that serves as a rotation drive unit for moving the rocking member 60 immediately after completion of conveyance of the toner from the toner supplying unit 30 to the toner conveyance path 52. The above-described action can prevent the rocking member 60 from interfering the toner conveyance. Further, the above-described action can surely prevent the toner adhesion to the overall surfaces of the inner walls of the toner conveyance path 52 from accumulating with time and becoming firmly fixed to the inner walls, without performing complex controlling.

Further, according to an exemplary embodiment of the present invention, the copier 1 that serves as an image forming apparatus includes the photoconductor 10 that serves as an image carrier, the developing unit for developing an electrostatic latent image formed on the surface of the photoconductor 10 to a toner image, the transfer unit 25 for transferring the toner image formed on the surface of the photoconductor 10 onto the recording sheet S that serves as a recording medium, and the cleaning unit 13 for removing residual toner adhering to the surface of the photoconductor 10 after transfer. The copier 1 uses the toner conveyance unit 50 as at least one of a first toner conveyance unit to convey toner from the toner supplying unit 30 that contains new or fresh toner to the developing unit 12, a second toner conveyance unit to convey the toner that is collected from the photoconductor 10 from the cleaning unit 13 to the developing unit 12 for reusing and recycling, and a third toner conveyance unit to convey the collected toner from the cleaning unit 13 to the toner collection tank. The use of the toner conveyance unit 50 serving as a powder conveyance unit applicable to the prevent invention can prevent occurrence of defective toner transfer and effectively achieve good image forming.

In the above-described exemplary embodiments, the rocking member 60 is employed to remove toner adhering to the inner walls of the toner conveyance path 52, which includes the toner conveyance paths 52*a*, 52*b*, 52*c*, and 52*d*, of the toner conveyance unit 50, which includes the toner conveyance units 50*a*, 50*b*, 50*c*, and 50*d*, each of which conveying the toner from the toner supplying unit 30 to the developing unit 12. However, the toner conveyance unit 50 according to the present invention is not limited to but can be applied to a configuration, for example, in which residual toner removed from the surface of the photoconductor 10 by the cleaning unit 13 is conveyed to the toner collection tank. Further, the toner conveyance unit 50 according to the present invention can also be applied to a configuration, for example, the toner collected from the surface of the photoconductor 10 by the cleaning unit 13 and conveyed to the developing unit 12. Accordingly, the toner conveyance unit 50 according to the present invention can achieve the same effect as described above, for example, toner may not be clogged in the toner conveyance path.

The above-described exemplary embodiments are illustrative, and numerous additional modifications and variations are possible in light of the above teachings. For example, elements and/or features of different illustrative and exemplary embodiments herein may be combined with each other and/or substituted for each other within the scope of this disclosure. It is therefore to be understood that, the disclosure of this patent specification may be practiced otherwise than as specifically described herein.

Obviously, numerous modifications and variations of the present invention are possible in light of the above teachings. It is therefore to be understood that, the invention may be practiced otherwise than as specifically described herein.

What is claimed is:

1. A powder conveyance unit, comprising:

a path forming member configured to form a powder conveyance path including an inner wall to convey powder therethrough, the path forming member connecting a first powder container and a second powder container to pass the powder from the first powder container to the second powder container through the powder conveyance path;

a substantially planar plate-like powder remover configured to remove powder adhering to the inner wall of the powder conveyance path; and a moving mechanism configured to move the plate-like powder remover, the moving mechanism moves the plate-like powder remover between completion of one conveyance of toner from the first powder container to the powder conveyance path and start of a subsequent conveyance of toner from the first powder container to the powder conveyance path, the plate-like powder remover disposed in the powder conveyance path with both lateral edges thereof in a width direction perpendicular to a powder conveyance direction in the powder conveyance path contacting or nearly contacting the inner wall of the powder conveyance path, opposed flat surfaces of the plate-like powder remover moving reciprocally between opposed surfaces of the inner wall of the powder conveyance path to remove powder adhering to the surfaces of the inner wall of the powder conveyance path.

2. The powder conveyance unit according to claim 1, wherein the plate-like powder remover moves in a direction intersecting the powder conveyance direction in the powder conveyance path.

3. The powder conveyance unit according to claim 1, wherein one end of the plate-like powder remover is rotatably fixed to a bearing member and a free end of the plate-like powder remover extends in the powder conveyance direction.

4. The powder conveyance unit according to claim 3, wherein the free end of the plate-like powder remover includes a substantially elastic portion.

5. The powder conveyance unit according to claim 1, wherein the moving mechanism moves the plate-like powder remover immediately after completion of conveyance of the powder from the first powder container to the powder conveyance path.

6. The powder conveyance unit according to claim 1, wherein the first powder container comprises a rotating powder conveyor configured to convey the powder upward to the powder conveyance path during rotation thereof, the moving mechanism comprising a rotary shaft rotatably fixing the plate-like powder remover and an arm attached to the rotary shaft, each integrally mounted on the plate-like powder remover, the rotation of the powder conveyor conveying the powder upward causing the powder conveyor to contact the arm and move the plate-like powder remover.

7. An image forming apparatus, comprising:

an image carrier configured to carry an image on a surface thereof;

a developing unit configured to develop a latent image formed on the surface of the image carrier into a toner image with toner;

a transfer unit configured to transfer the toner image on the surface of the image carrier onto a transfer member;

a cleaning unit configured to remove residual toner remaining on the surface of the image carrier after transfer; and the powder conveyance unit according to claim 1, serving as one of:

a first toner conveyance unit configured to convey toner from a toner supplier configured to contain new toner to the developing unit;

a second toner conveyance unit configured to convey collected toner from the cleaning unit to the developing unit; and a third toner conveyance unit configured to convey collected toner from the cleaning unit to a waste toner collecting unit.

8. The image forming apparatus according to claim 7, wherein the plate-like powder remover of the powder conveyance unit moves in a direction intersecting the powder conveyance direction in the powder conveyance path.

9. The image forming apparatus according to claim 7, wherein one end of the plate-like powder remover is rotatably fixed to a bearing member and a free end of the plate-like powder remover extends in the powder conveyance direction.

10. The image forming apparatus according to claim 9, wherein the free end of plate-like powder remover includes a substantially elastic portion.

11. The image forming apparatus according to claim 7, wherein the moving mechanism moves the plate-like powder remover immediately after completion of conveyance of the powder from the first powder container to the powder conveyance path.

12. The image forming apparatus according to claim 7, wherein the first powder container comprises a rotating powder conveyor configured to convey the powder upward to the powder conveyance path during rotation thereof, the moving mechanism comprising a rotary shaft rotatably fixing the plate-like powder remover and an arm attached to the rotary shaft, each integrally mounted on the plate-like powder remover, such that the rotation of the powder conveyor conveying the powder upward causes the powder conveyor to contact the arm and move the plate-like powder remover.

13. A powder conveyance unit, comprising:

powder conveyance path means for forming a powder conveyance path including an inner wall to convey powder therethrough, the powder conveyance path means connecting a first powder container and a second powder container to pass the powder from the first powder container to the second powder container through the powder conveyance path;

powder removal means for removing the powder adhering to the inner wall of the powder conveyance path; and drive means for moving the powder removal means immediately after completion of conveyance of the powder from the first powder container to the powder conveyance path, the powder removal means supported along a width direction of the powder conveyance path perpendicular to a powder conveyance direction of the powder conveyance path such that opposed lateral edges of the powder removal means contact or nearly contact the inner wall of the powder conveyance path in the width direction of the powder removal means, opposed surfaces of the powder removal means moving reciprocally between opposed surfaces of the inner wall of the powder conveyance path to remove powder adhering to the surfaces of the inner wall of the powder conveyance path.

14. The powder conveyance unit according to claim 13, wherein the powder removal means moves in a direction intersecting the powder conveyance direction of the powder conveyance path.

15. The powder conveyance unit according to claim 13, wherein the powder removal means moves in the powder conveyance path while being rotatably supported by a bearing member.

16. The powder conveyance unit according to claim 13, wherein the powder removal means flexibly contacts opposed surfaces of the inner wall of the powder conveyance path.

17. The powder conveyance unit according to claim 13, wherein the first powder container comprises conveyance means for conveying the powder upward to the powder conveyance path during rotation thereof, the drive means comprising support means for rotatably supporting the powder removal means and linking means for linking the powder removal means and moving with the support means, both the support means and the linking means integrally operating with the powder removal means, the powder removal means being moved by a moving force applied by the means for conveying to the means for linking in association with an action of the means for conveying.

18. An image forming apparatus, comprising:

an image carrier configured to carry an image on a surface thereof;

a developing unit configured to develop a latent image formed on the surface of the image carrier into a toner image with toner;

a transfer unit configured to transfer the toner image on the surface of the image carrier onto a transfer member;

a cleaning unit configured to remove residual toner remaining on the surface of the image carrier after transfer;

a toner bottle to store toner used to form the image, the toner bottle including multiple projections;

a path to convey toner from the toner bottle; and a powder remover having a contact surface, the powder remover at least partially disposed in the path, to remove toner which is in the path, the powder remover operating by movement when the contact surface contacts the projections of the toner bottle.

* * * * *